US005890963A

United States Patent [19]

Yen

[11] Patent Number: 5,890,963

[45] Date of Patent: Apr. 6, 1999

[54] SYSTEM AND METHOD FOR MAINTAINING CONTINUOUS AND PROGRESSIVE GAME PLAY IN A COMPUTER NETWORK

[76] Inventor: Wei Yen, 10431 Plum Tree La., Cupertino, Calif. 95014

[21] Appl. No.: 727,819

[22] Filed: Sep. 30, 1996

[51] Int. Cl.[6] ..... A63F 9/24

[52] U.S. Cl. ..... 463/42

[58] Field of Search ..... 463/40, 41, 42, 463/43, 29; 273/461

[56] References Cited

U.S. PATENT DOCUMENTS

| | | | |
|---|---|---|---|
| 5,695,400 | 12/1997 | Fennell, Jr. et al. | 463/42 |
| 5,766,076 | 6/1998 | Pease et al. | 463/27 |
| 5,779,549 | 7/1998 | Walker et al. | 463/42 |

*Primary Examiner*—George Manuel

*Attorney, Agent, or Firm*—Carr & Ferrell LLP

[57] ABSTRACT

A system for maintaining continuous and progressive game play in a computer network. The system includes at least one server and at least one game-playing client, in communication with each other through a computer network. Each server includes a memory storing game data which includes initial game data specifying an initial game state and which includes accumulated game data specifying updates to the initial game state. Either the server or the client includes memory storing knowledge base rules and storing an executable computer game program for applying the knowledge base rules to the game data. The executable computer game program generates responses to the client and updates the accumulated game data. The system optionally comprises a second game-playing client and a second server including memory which stores game data connected to the network. The game data in the second server may be derived from and identical to the game data in the first server, thereby establishing a second instance of the first server game state.

49 Claims, 10 Drawing Sheets

SYSTEM AND METHOD FOR MAINTAINING CONTINUOUS AND PROGRESSIVE GAME PLAY IN A COMPUTER NETWORK

BACKGROUND OF THE INVENTION

1. Field of the Invention

This invention relates generally to computer networks, and more particularly to a system and method for maintaining continuous and progressive game play in a computer network.

2. Description of the Background Art

Modern computer games have a beginning and an ending, and do not progress while a player is not playing. When a player boots up a computer game, the game either starts at the beginning or resumes where the player last left off.

An example of a well known, conventional computer game is the game of Adventure. A player starts the game, and for example, finds himself on a path standing next to a key lying on the floor. The player instructs the character to pick up the key. Accordingly, the character picks up the key and the game requests further instructions. The player instructs the character to proceed forward down the path by typing the word "forward" using the computer keyboard. The game responds by displaying the message "You have entered a cave." The player then instructs the character to turn left. The character accordingly turns left, and the game informs the player that the character is now facing a long hallway with a light in the distance. At any point, the player may save the game, thereby saving game assets, i.e., the key, and saving game status, i.e. facing a long hallway. Thus, when the player resumes play, he finds the character holding the key, facing the hallway, etc. While the player is not playing, the game environment does not progress and the player's status remains unchanged.

Another example of a modern computer game is Sim-City®, manufactured by Maxis of Walnut Creek, Calif. Sim-City® provides a single-user game environment for building a virtual city, including residential areas, parks, utilities, business districts, etc. The player designs the city. As time passes, virtual characters move into or out of the residential areas, drive their cars to and from the business districts, etc. While a user is effecting changes to the city and while the user provides no input, the game continues. The city continues to earn revenues, the people continue to purchase property, natural disasters still occur, etc. However, when the player leaves the game environment, i.e., quits the game, the game stops.

Modern computer games do not enable a player to use a character in other game environments. If a character is created and developed in one game environment, the same character cannot enter into another game environment. For example, in a modern martial art simulator, a character may acquire new powers and new weaponry as the game progresses. The player cannot enter into another more advanced game environment, while maintaining its current knowledge and assets, to begin new game play.

Therefore, a system and method are needed for enabling progressive and continuous game play in a game environment, for enabling multiple players to enter multiple game environments, and for enabling players to maintain current knowledge and assets between game environments.

SUMMARY OF THE INVENTION

The present invention overcomes limitations and deficiencies of previous systems by providing a system and method for maintaining continuous and progressive game play in a network. The system includes a first server connected through a computer network to a first game-playing client.

The first server includes memory storing game data, which includes initial game data specifying an initial game state and accumulated game data specifying updates to the initial game state. Either the first server or the first game-playing client includes memory containing knowledge base rules and an executable computer game program for applying the knowledge base rules to the game data. Accordingly, the executable computer game program generates responses to the first game-playing client, and updates the accumulated game data and thus the first server game state.

The network optionally further comprises a franchiser memory connected either to the network or to the first server. The franchiser memory stores initial game data, knowledge base rules and executable computer game programs for a specific game. The first server and the client access the franchiser memory to obtain the game information needed to initiate game play.

The system optionally further comprises a second game-playing client connected through the network to the first server. A second server, which includes memory storing game data, may also be connected to the network. The game data in the second server may be derived from and identical to the game data in the first server, thereby establishing a second instance or franchise of the first server game state. However, as the games are played on each of the first and second servers, different game states will develop.

The present invention also provides a method for maintaining continuous game play across a computer network. The method begins by connecting a first server, which includes game data, to the computer network. The game data may have been obtained from the franchiser memory or from another server. A first game-playing client is connected through the network to the first server. One of the first server or the first game-playing client includes memory storing knowledge base rules and an executable game program. Similarly, the knowledge base rules and the executable game program may have been obtained from the franchiser memory or from another server. Using the executable game program, the knowledge base rules are applied to the game data. Accordingly, responses are generated to the first game-playing client, and the game data is updated.

An example of a system which embodies the present invention includes a stock market simulator in a computer network. A server comprises memory storing the stock market game program and initial game data, which includes a default set of virtual corporations selling stock, default stock prices, etc. The memory further stores accumulated data, which includes corporations added to the game by the server manager, each character's current portfolio, etc. Game-playing clients communicate through the network with the server to trade stock. Based on client transactions, the accumulated data is modified. Stock prices rise, stocks split and clients go bankrupt.

To create another instance of the stock market simulator, the stock market game and initial data are loaded into another server in the network. To create an identical instance of the stock market simulator, the accumulated data is also loaded into the other server. As the games progress, the two servers will develop unique game states.

DETAILED DESCRIPTION OF THE PREFERRED EMBODIMENT

Figure 1:
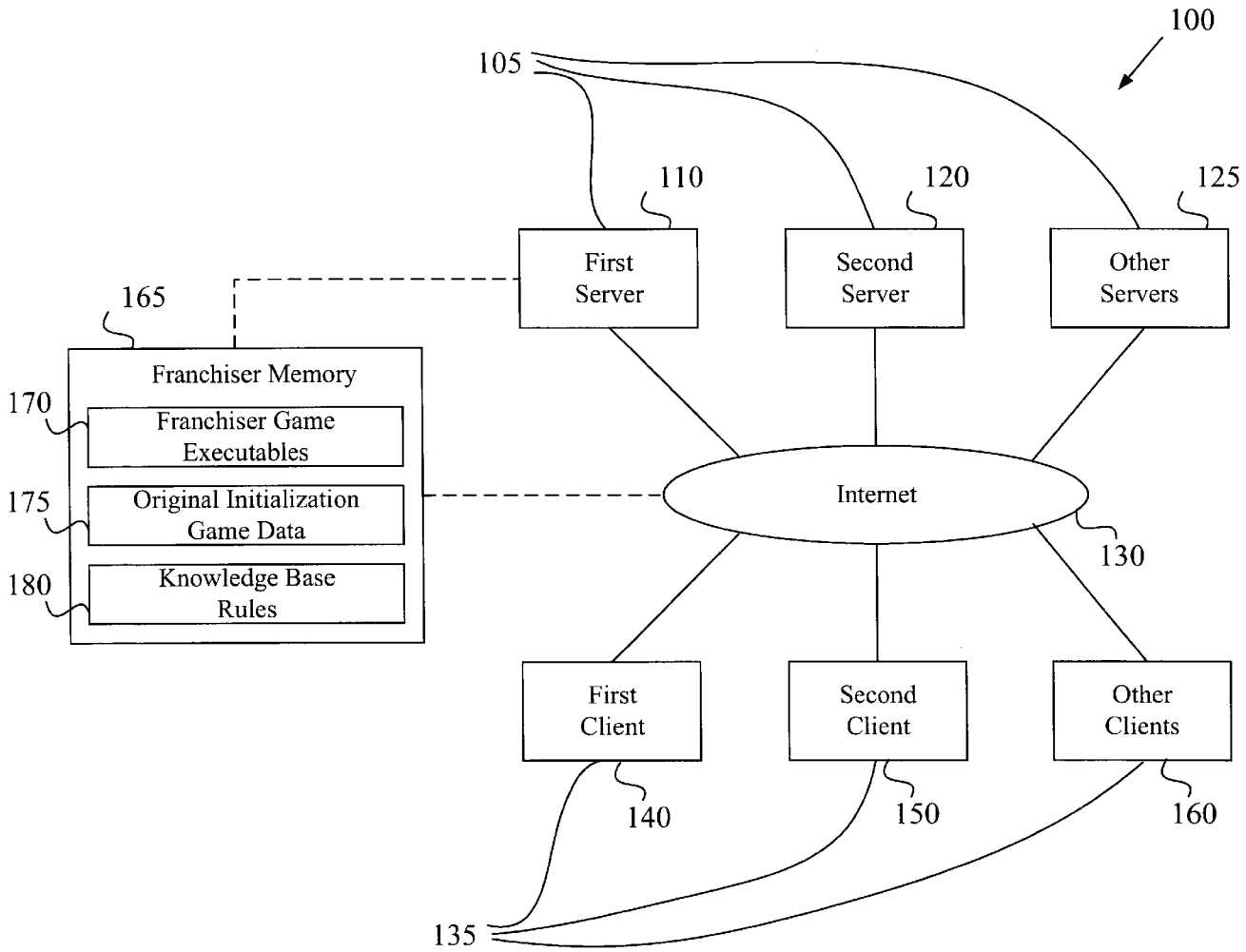
FIG. 1 is a block diagram illustrating a network in accordance with the present invention.

Referring now to FIG. 1, a block diagram is shown of a computer network 100 enabling continuous and progressive game play in accordance with the present invention. FIG. 1 shows the connection of multiple clients 135 (players) across an internet 130 to individual servers 105. More particularly, the network 100 includes a first server 110, a second server 120 and other servers 125 each coupled through the internet 130 to clients 135. Clients 135 preferably includes a first client 140, a second client 150 and other clients 160. A franchiser memory 165 may be coupled to either the first client 110 or to the internet 130.

The first server 110 maintains the rules and data for a particular game such as a stock market simulator. The first client 140 sends a request to play the game through the internet 130 to the first server 110, which accordingly sends the game rules and game data back through the internet 130 to the first client 140. The first client 140 uses the game rules and data to set up a game environment, which includes game characters, game status, etc. If the first client 140 is requesting the start of the game for the first time, then the first server 110 provides the first client 140 with default client data such as, for example, a new character information. Otherwise, the first client 140 retrieves previous client data.

Transferring status information between the server 110 and the first client 140 occurs in a "listen in" mode, i.e., where each client listens in on the actions and status of the server 110. For example, during the listen in mode of a stock market simulator, the first client 140 connects with the first server 110. This connection constitutes listen in, since the client's presence alone indicates interest in purchasing or selling stock. Accordingly, the first server 110 sends stock information to the first client 140. The first client 140 optionally buys or sells stock, and sends the stock transfer information back to the first server 110. Each of these actions occurs in listen in mode. Based on the transactions, the first server 110 updates the game data and the game status by, for example, modifying stock prices.

The franchiser memory 165 is computer memory such as RAM, CD ROM, floppy disks, hard disks, etc. which stores franchiser game executables 170, original initialization game data 175 and knowledge base rules 180 for a multitude of games. These games may include a stock market simulator as described in all the figures and may include a game of "diner" as described with reference to FIG. 10. The franchiser memory 165 is connected to either to the first server 110 or to the internet 130. The first server 110 and the first client 110 retrieve executable computer game programs from the franchiser game executables 170, initial game data from the original initialization game data 175 and game rules from the knowledge base rules 180. The franchiser memory 165 preferably acts as a repository of the game program produced by the game designer or game author. Alternatively, franchiser memory 165 is a package of distribution media, such as a CD-ROM, as may be found in a commercially distributed game. The executable computer game program, initial game data and game rules needed to initiate a game are described in greater detail with reference to FIGS. 2–10.

The network 100 optionally further includes a second server 120 and other servers 125, each operating similarly to the first server 110. Since each client 140, 150 which has listened in has likely made unique choices, server 120 likely has different game data and a different game status than server 110.

Figure 2:
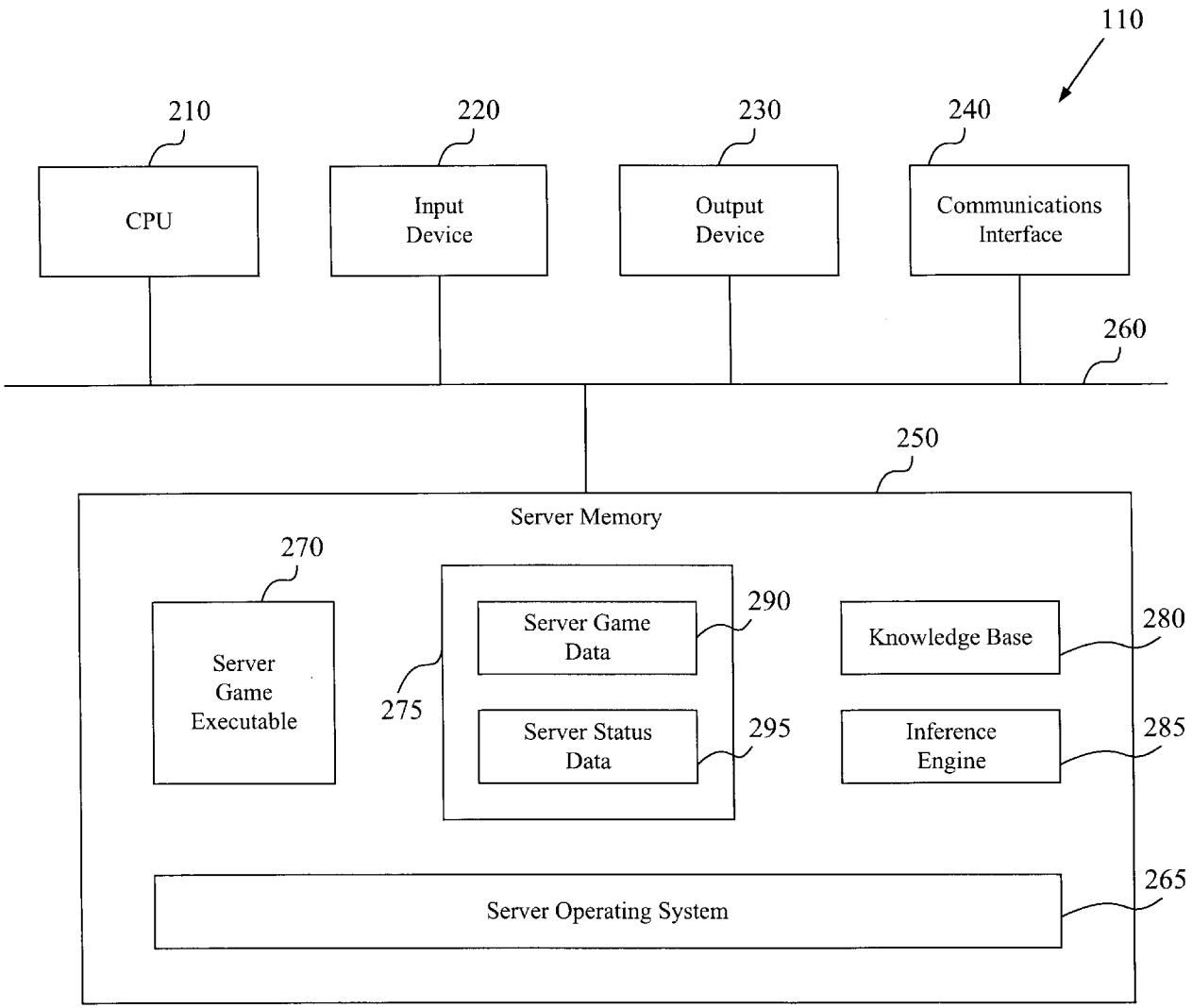
FIG. 2 is a block diagram illustrating details of the network server of FIG. 1.

Referring now to FIG. 2, a block diagram is shown of the server 110 (or server 105). The server 110 includes a Central Processing Unit (CPU) 210, which is based on a computer such as a Power Macintosh® computer manufactured by Apple Computer, Inc. of Cupertino, Calif. or such as an IBM® PC manufactured by IBM Corporation of Armonk, N.Y. The server 110 further includes an input device 220 such as a keyboard and mouse, an output device 230 such as a Cathode Ray Tube (CRT) display, a communications interface 240 for communicating with the internet 130, and a server memory 250 such as Read Only Memory (ROM), a hard disk drive and Random Access Memory (RAM), each coupled via a signal bus 250 to CPU 210.

The server memory 250 stores a server operating system 265, which is a program for controlling CPU 210 processing. The memory 250 further stores a server game executable 270, server game data 290, a knowledge base 280, an inference engine 285 and server status data 295. The server game data 290 and the server status data 295 are stored in an area of memory 250 referred to as the server "rendezvous" memory 275, which represents the memory location where all communications are made between a server 105 and a client 135.

The game data 290 includes dynamic information needed for setting up the game environment and game status. In the stock market example, the game data 290 may include information specifying virtual characters, virtual character assets, etc. The knowledge base 280 includes the game rules upon which the game data is applied. The knowledge base 280 rules needed to initiate game play may be retrieved from the knowledge base rules 180 of the franchiser memory 165 or from another server 105. Referring again to the stock market example, the game rules may include rules specifying market trends, specifying which brokers can buy or sell stock, specifying whether to loan money to a client 135 specifying requirements for a corporation to enter the market, etc. The game data 290 may specify that a virtual character owns one hundred stock shares of a particular corporation, that the stock for this corporation is currently being sold at $50.00, and that the character's current financial value is determinable at approximately $5000.00.

The server game executable 270 is a program routine, which applies the knowledge base 280 rules to the game data 290 dynamic information, and accordingly generates responses. For example, if the client 135 requests a stock purchase, the server game executable 270 retrieves from the knowledge base 280 rules for determining whether the corporation has stock to sell, whether the client 135 has enough money or credit to buy, etc. The server game executable 270 applies the rules to the current game data 290 information, and if the conditions are met, responds by billing the client's account and transferring the stock from corporate assets to the client.

The inference engine 285 is a program routine which uses either formal logic rules or statistical generalizations to derive inferences from the knowledge base 280 rules and game data 290 dynamic information. The inference engine 285 can also induct new rules from the inferences derived, and subsequently adds the new rules to the knowledge base 280. In the stock market example, the inference engine 285 may determine that since corporations have chief executive officers and since ABC, Inc. is a corporation, then ABC, Inc. has a chief executive officer.

The server status data 295 specifies system information including baud rates, including server housekeeping and security data such as access codes and security level procedures, and including game software updates such as updated versions. The server status data 295 further specifies game information including the clients 135, franchises, etc. registered to communicate with the particular server 105.

Figure 3:
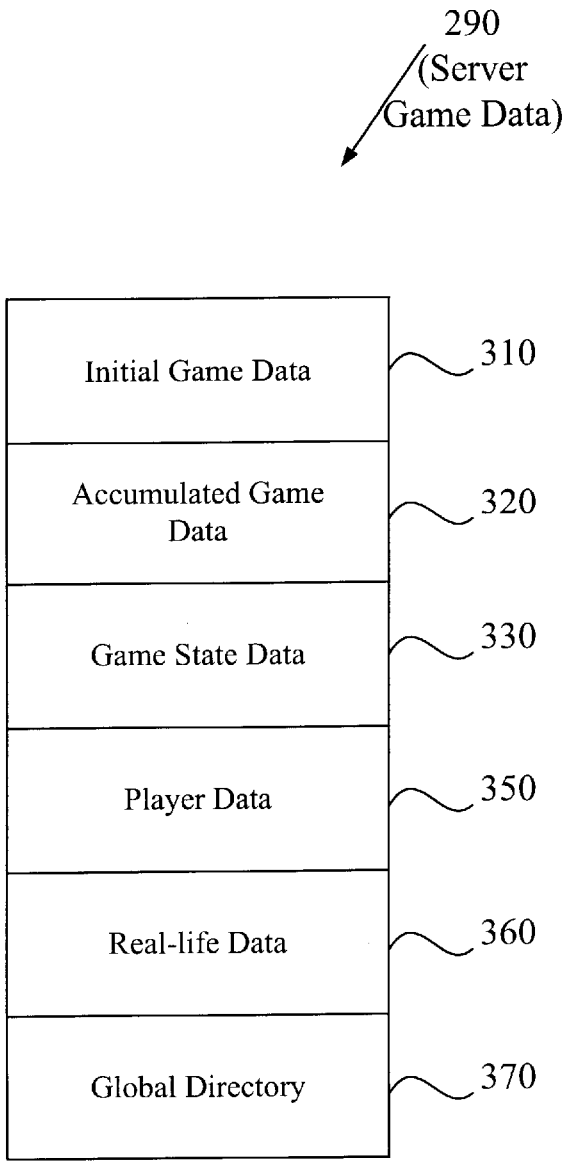
FIG. 3 is a block diagram illustrating the server game data of FIG. 2.

Referring now to FIG. 3, a block diagram is shown of the server game data 290, which comprises initial game data 310, such as the default virtual characters and default game status, as set by the game designer. The initial game data 310 may be retrieved from the original initialization game data 175 of the franchiser memory 165 (FIG. 1) or from another server 105. In the stock market example, the initial game data 310 includes a default set of virtual corporations (i.e. characters) and each default stock price. Initial data may also include an initial quantity of assets with which each character begins and the brokers with whom the player is currently associated. The server game data 290 further comprises accumulated game data 320, which includes characters added to the server 110 by the server manager (not shown) and each character's portfolio. Game state data 330, which in the stock market example includes current stock prices, corporate values and current market trends, is also included.

The server game data 290 optionally further comprises player data 350, which includes a history, assets, knowledge and status of a client 135 currently listening in. Real-life data 360 may also be included, for representing real world events such as natural disasters, corporate mergers, seasons, etc., whether true or not, whether received automatically or manually. The server game data 290 may further include a global directory 370 listing available franchises and associated franchise advertising. Franchising and franchise advertising are described in greater detail with reference to FIG. 9 and FIG. 10.

Figure 4:
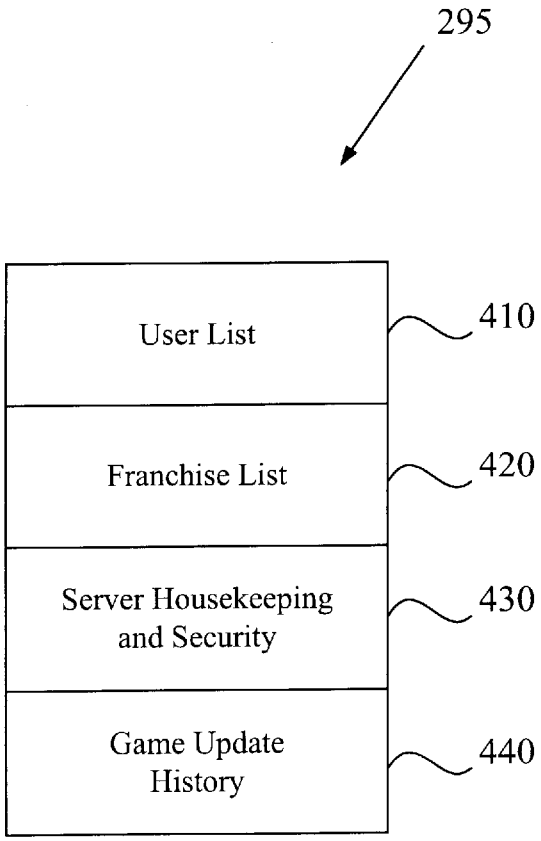
FIG. 4 is a block diagram illustrating the server status data of FIG. 2.

Referring now to FIG. 4, a block diagram is shown of the server status data 295, which includes a registered user list 410 specifying the clients 135 and includes a registered franchise list 420 specifying the franchises registered to communicate with the particular server 105. Franchises are additional instances (installed copies of a specific game), optionally added to the system by cloning the server game data 290 and the knowledge base 280 to produce an identical copy of the game and the game state. Franchising is further described below, with reference to FIG. 9. Server status data 295 further includes server housekeeping and security data 430, which includes initialization routines to execute upon server 105 start-up, for establishing user password and security level procedures. The server status data 295 further includes a game update history 440, including game software updates, i.e., updated versions, new objects, new modules or the like. Although not shown in FIG. 4, other server status data 295 specifying system and game information such as baud rates, amount of disk space remaining, amount of RAM being used, etc. may be included.

Figure 5:
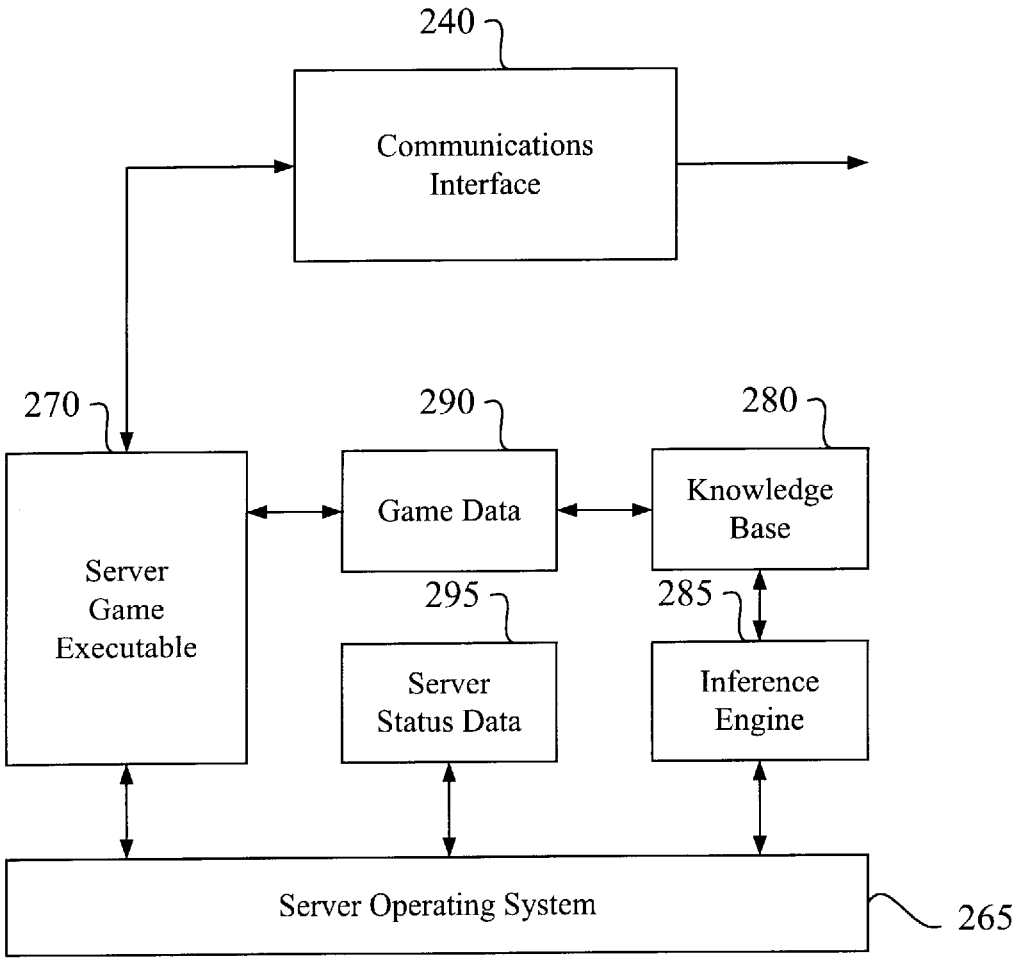
FIG. 5 is a block diagram illustrating server element interaction in accordance with the present invention.

Referring now to FIG. 5, a block diagram is shown illustrating interaction of the server 110 elements. The server game executable 270 receives a request through the communications interface 240 to perform a high level command, such as a stock purchase from the client 135. The server game executable 270 sends the transaction information to the game data 290 for updating the accumulated game data 320, the game state data 330 and the player data 350. The game data 290 is then forwarded to the knowledge base 280 for retrieving rules associated with the particular request.

With the assistance of the server operating system 265, the game executable 270 applies the rules retrieved from the knowledge base 280 to the updated game data 290. In the stock market example, the game executable 270 bills the client 135, transfers the stock to the client 135, updates the server status data 295, etc. The server status data 295 uses the transaction information to modify the game update history 440.

The inference engine 285 uses either formal logic rules or statistical generalizations to derive inferences from the knowledge base 280 rules and game data 290 dynamic information. By observing user interaction with existing data and rules, the inference engine 285 inducts new game rules and adds them to the knowledge base 280.

Because the server game executable 270 maintains a progressive data base, the game can proceed in a systematic manner. More particularly, the first server 110 maintains game progression whether or not a client 135 is connected to the server 110 by receiving through the communications interface 240 other information such as real world events, artificial data or derived data to be added to the game data 290. The other information may be added manually, i.e., by an authorized server manager (not shown) of the game server 110, or automatically.

It will be appreciated that since each client 135 may listen in on the same server 105, multiple clients 135 may "concurrently" participate in a game. It will be further appreciated that the listen in model supports game continuity in each server 105 and supports client continuity in each client 135. Continuity is the logical and systematic progression of computer events. Server continuity refers to the logical and systematic progression of the status of the game. In the stock market example, regardless of whether any clients are listening in, the stock market will continue to fluctuate, natural disasters will continue to occur and companies will continue to come and go in a logical and systematic manner. Server continuity is enabled by the storage of server game data 290 on the server 105. In a preferred embodiment, the server 105 runs the game continuously updating the server game data 290, while modifying real-life data 360 and accumulated game data 320 as the game progresses. Alternatively, the server can either store game state data 330 for a particular client 135 in server memory 250 or receive game state from the client 135 when the client listens in to resume play, in order to tailor game progression to the play habits of each client. The tailoring of game progression may be particular useful for infrequently connected clients 135 (players) who might otherwise return to the game after an extended period and find the game environment so completely changed due to server continuity so as to interfere with game enjoyment.

Client continuity refers to the logical and systematic progression of client status, relative to one or more servers. In the stock market example, the client 135 maintains a stock portfolio whether or not the client listens in to the server 105. If a stock splits, the client's portfolio will reflect this change. Furthermore, client continuity describes the ability of a client 135 to carry game status information from one server 105 to another. Referring again to the stock market game example, a client 135 (player) may have specific accumulated resources such as an investment cash account of $100 and a line of credit with a broker of $50. Client game continuity enables the client 135 to play on a first server 110, perhaps representing the New York Stock Exchange, and subsequently play on a second server 120, which might represent the NASDAQ. In moving between the first server 110 and the second server 120 the client's 135 accumulated resource information is preserved. If a $45 cash purchase is made on the first server 110 New York Stock Exchange (NYSE) game, the client's 135 cash balance will drop, leaving only $55 to invest with the second server's 120 NASDAQ game.

Because of client continuity and server continuity, a client 135 may play concurrently two games on two servers 105 by maintaining either two separate data bases storing game data for the two servers 105 or a single data base storing the combined game data for the two servers 105. For example, the client 135 may have a data base storing all client stocks for both NASDAQ and NYSE games. The combined data base represents the client's 135 net worth. Alternatively, a client 135 may have a data base storing the NASDAQ game data and a data base storing the NYSE game data, wherein each data base represents the client's net worth in the corresponding game.

Figure 6:
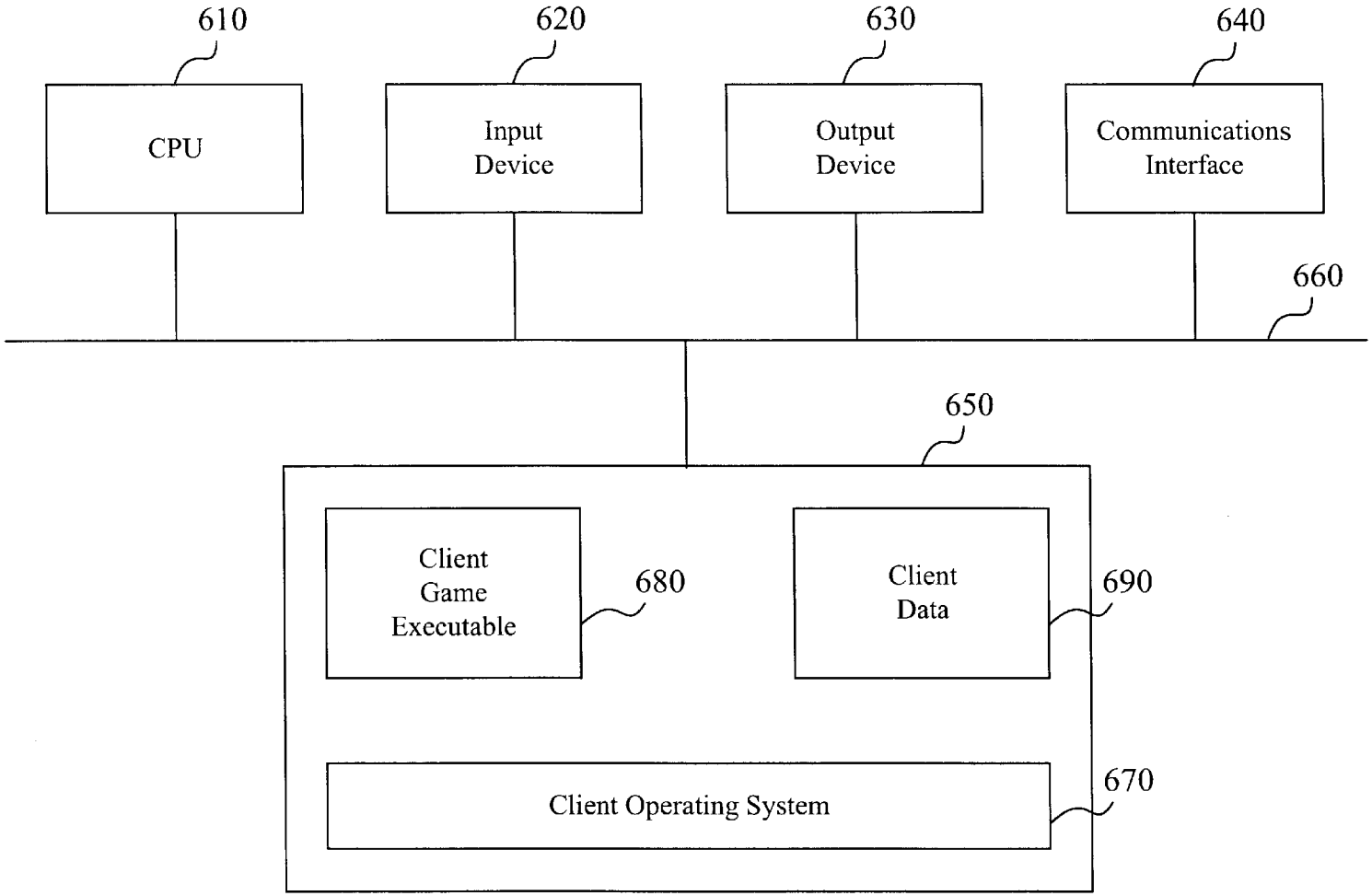
FIG. 6 is a block diagram illustrating details of the client of FIG. 1.

Referring now to FIG. 6, a block diagram is shown of the first client 135. Similarly to server 110, client 135 includes a CPU 610, an input device 620, an output device 630, a communications interface 640 for communication with the internet 130 and a client memory 650, each coupled to a signal bus 660.

The client memory 650 stores a client operating system 670 for controlling CPU 610 processing. The client memory 650 further stores a client game executable 680, which may have been retrieved from the franchiser game executables 175 of the franchiser memory 165 (FIG. 1), for processing client data 690. The game executable 680 uses the communications interface 640 to communicate with a server 105 for receiving server game data 290 or server game executable 270 code, such as applets, which may be used in a distributed network operating environment such as Java. The client game executable 680 uses the information received from the server 105 to set up a game environment and to generate responsive communications.

A client 135 may include a dedicated knowledge base and an inference engine, similar to the knowledge base 280 and the inference engine 285 as described with reference to the server 110 of FIG. 2. Alternatively, the client 135 may include a subset of or share portions of the knowledge base 280 and the inference engine 285 of the server 135. Using the knowledge base and inference engine, the client 135 can generate new rules and upload these rules into the knowledge base 280 of the server 135.

Figure 7:
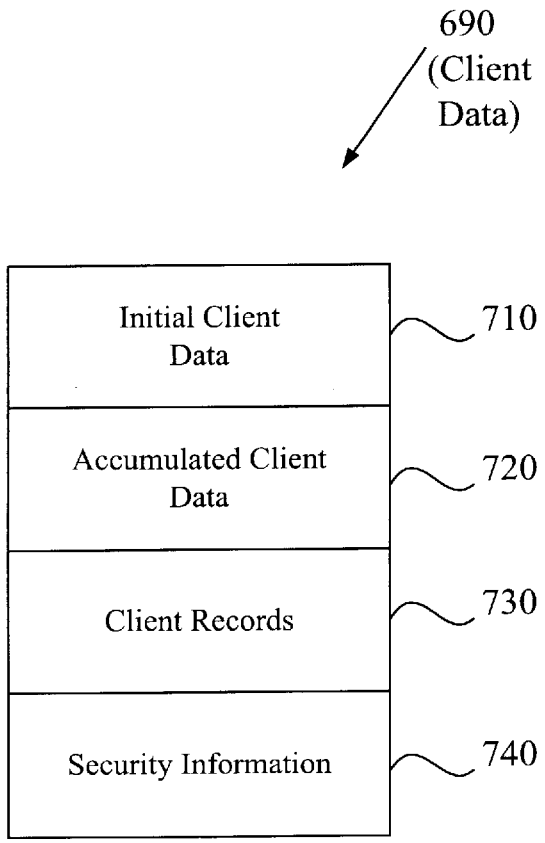
FIG. 7 is a block diagram illustrating the client game data of FIG. 5.

Referring now to FIG. 7, a block diagram is shown illustrating the client data 690, which comprises initial client data 710, accumulated client data 720, client records 730 and security information 740. The initial client data 710 includes the game designer's rules and data for initial game play, such as default characters, character assets, and the initial character skill and sophistication level. The initial client data 710 may have been retrieved from the original initialization game data 175 of the franchiser memory 165 or from the server 105 to which the client 110 has connected. The accumulated client data 720 includes all information accumulated during game play such as, in the stock market example, currently-owned stocks and current knowledge.

The client records 730 includes a history of the client's past states. For example, the records 730 may include client financial history and corporate stock preferences. Client records 730 also includes score relative to other players. The security information 740 includes client passwords and security clearances for enabling access to user information.

Figure 8:
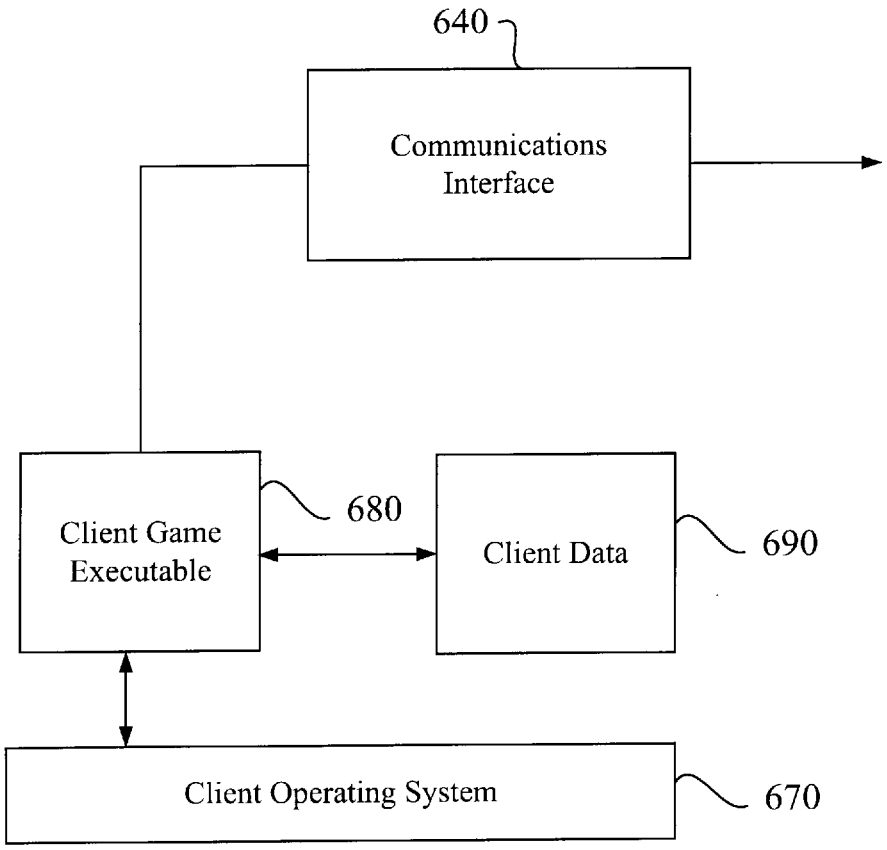
FIG. 8 is a block diagram illustrating client element interaction in accordance with the present invention.

Referring now to FIG. 8, a block diagram is shown illustrating interaction of the client 135 elements. The client game executable 680 forwards a message through the communications interface 640 to a server 105. The client 135 accordingly receives a response through the communications interface 640 from the server 105. Client game executable 680 and the communications interface 640 are conventionally controlled and supported by resources contained in the client operating system 670.

In the stock market example, a first client message may specify that the first client 140 is listening in on the actions of the server 110, and a second client message may include the security information 740 for enabling access to client information. The server 110 response may include priority access codes, a list of the currently available stocks and the current stock prices. Accordingly, the first client 140 may request a stock purchase. If the server 110 approves the purchase, the server 110 will send stock transfer information and a bill. The client game executable 680 uses the server response to update the client data 690, or more particularly to update the accumulated client data 720 and the client records 730.

It should be noted that the specific storage location of the game data, whether it be on a server 105 or on the client 135, is not particularly important for the practice of this invention. In the preferred embodiment, the bulk of the game data is preferably stored as client data 690, to reduce hardware and communication burdens on the part of the server 105. At the present time, however there is a shift to the use of low cost internet access appliances, containing minimal processor power and storage capability. Assuming these appliances become more popular, the alternative embodiment of storing a bulk of the game data on the server 105 (server game data 290) may be preferred. In any event, the game data must be accessible by the client 135.

Figure 9:
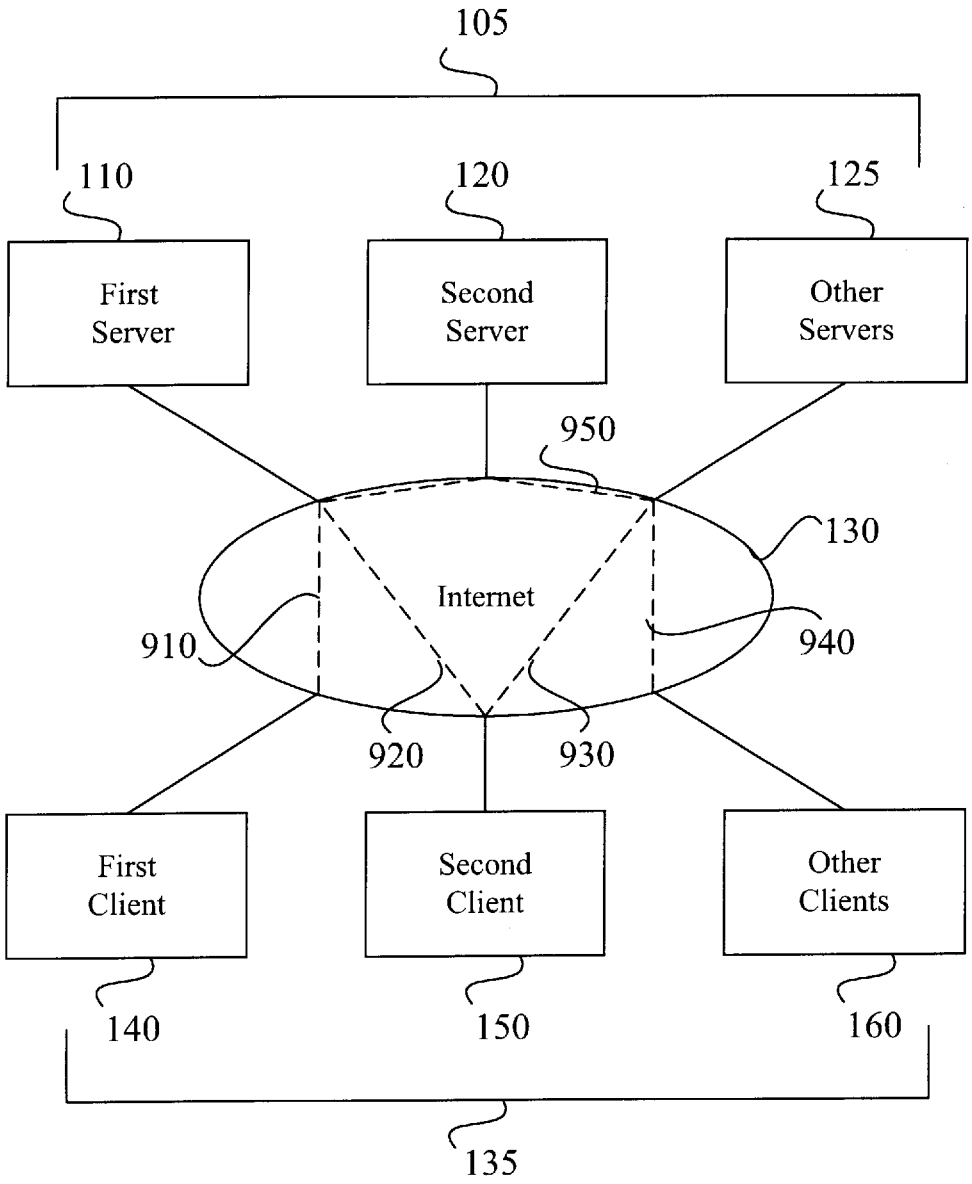
FIG. 9 is a block diagram illustrating communications between clients and servers across an internet in accordance with the present invention.

Referring now to FIG. 9, a block diagram is shown illustrating an example internet 130 interconnection, enabling communication between the servers 105 and the clients 135. The interconnection includes a path 910 connecting the first client 140 to the first server 110, a path 920 connecting the second client 150 to the first server 110, a path 930 connecting the second client 150 to the other servers 125, a path 940 connecting the other clients 160 to the other servers 125 and a path 950 connecting the other servers 105.

Because of the interconnection paths 910–950, a client 135 can listen in on any server 105 and can alternate between servers 110, 120, 125. In the stock market simulator example, the first server 110 may be dedicated to the transfer of stocks and bonds for multi-billion dollar companies, and the second server 120 may be dedicated to the transfer of stocks and bonds for start-up companies. The first client 140 may communicate via path 910 with the first server 110 for buying or selling certain stocks, and may communicate via paths 910 and 950 with the second server 120 for buying or selling other stocks. Based on the stock purchases and sales in both of these markets, the client 140 assets accumulate accordingly. It will be appreciated that stock prices in one market may or may not depend on the stock prices in the other market.

Path 950 extends the capabilities of the network 100 to include server interaction for exchanging knowledge base 280 rules, exchanging player data 350 such as individual client information and exchanging other data. Server interaction can therefore effect game status in each server 110, 120, and 125. In the stock market simulator example, because the first server 110 and the second server 120 can exchange information, stock purchases in one market can effect stock prices in the other market.

Additional instances (installed copies of a specific game) may optionally be added to the system 100 using a technique referred to herein as "franchising." Franchising is a technique for cloning the server game data 290 and the knowledge base 280 to produce an identical copy of the game and the game state. The franchised game starts in an identical state (preferably originating from franchiser memory 165) as the original game, and develops a unique game data 290 set and knowledge base 280 as the franchised game is played. The concept of franchising recognizes that the value of a specific game implementation lies not only in the instructions and the execution of the game (controlled by the server game executable 270), but is also largely embodied in the server game data 290 and knowledge base 280 rules that the game develops as play progresses. Since the game should become more interesting as the game data 290 and knowledge base 280 rules are affected by game play and server manager (the person who maintains the game server) enhancements, the value of the game should increase over time and with play. A server manager typically receives a copy of the game from the game developer (preferably originating from franchiser memory 165) and installs the game on the server 105, thereby making it accessible to clients 135 for play. The game state initially shipped by the developer comprises a default set of game data 290 (preferably as original initialization game data 175). This initial distribution of the game containing default game data 290 by the developer to the server 105 constitutes the most general case of franchising. Franchiser memory 165 preferably contains this initial distribution of the game. As clients 135 participate in the game, the knowledge base 280 and the server game data 290 develop and change. The server manager may further nurture the game by externally enhancing the game data 290 set and knowledge base 280, so that that the game becomes uniquely interesting or challenging relative to other instances of the game on other servers 125. Franchising enables the system manager of a game server 105 to copy and transfer the game server 105 specific settings to a separate server 105 or to operate the copy of the game as a second instance on the same server 105.

Several advantages result from game franchising. First of all, game franchising promotes competition among the various game system managers to operate an interesting and competitive game implementation. Since the artificial intelligence components (inference engine 285 and knowledge base 280) benefit the game instance which is most frequently played, often visited game servers 105 will tend to have more richly developed server game data and knowledge bases 280. Thus, these often visited game servers 105 will produce still more interesting game play and will draw even more players.

Since there may be economic benefit associated with frequent play through commercial advertising, etc., well run games will likely produce increased revenue to their managers. Multiple franchised instances of the same game with different data 290 and knowledge bases 280 will allow clients 135 (players) with basic knowledge of the rules to select among several similar game servers 105 for choosing the most interesting game site. Competition among the server managers will ultimately produce better game sites and therefore advantages clients 135.

A second advantage of the franchise system is that various commercial opportunities are created through the sale of franchises by successful game server managers. If a particular internet game is successful, demand for the game will increase, resulting in an increase in game value. Through franchising, server managers can transfer copies of the knowledge base 280 and the game data 290 to third party servers 105, thus enabling the third party server managers to set up a competitive game instance on their own server 105. By acquiring a franchise from an existing game server 105, the new franchise can begin immediate operation with an established knowledge and database. Because the game running on the existing server 105 is itself a franchise of an original game, this second generation cloning in effect produces a franchise of a franchise. Since operation of the franchise will be conducted by the new franchise, independent of the original franchiser, the franchised game will eventually develop a data 290 and knowledge base 280 separate from that of the original game from which it was franchised.

A third advantage of franchising is that the availability of franchised games promotes a wide distribution of instances of the most popular games, and thus makes it easier for clients 135 to find and access games at appropriate user levels. Games that have extremely rich data 290 and knowledge bases 280 may be complex to play, whereas newly initiated game instances may not have sufficient data 290 and knowledge bases 280 to be widely interesting. Franchising permits a convenient mechanism for satisfying supply and demand at a variety of levels. A somewhat indirect benefit of this enhanced distribution is the potential opportunity to create derivatives of the more popular games. A related derivative game can be developed which takes advantage of server or client continuity, and produces additional game playing opportunities. One example of such a related game might be a sequel in which player resources from a client 135 can be transferred from the original game to the related game.

Figure 10:
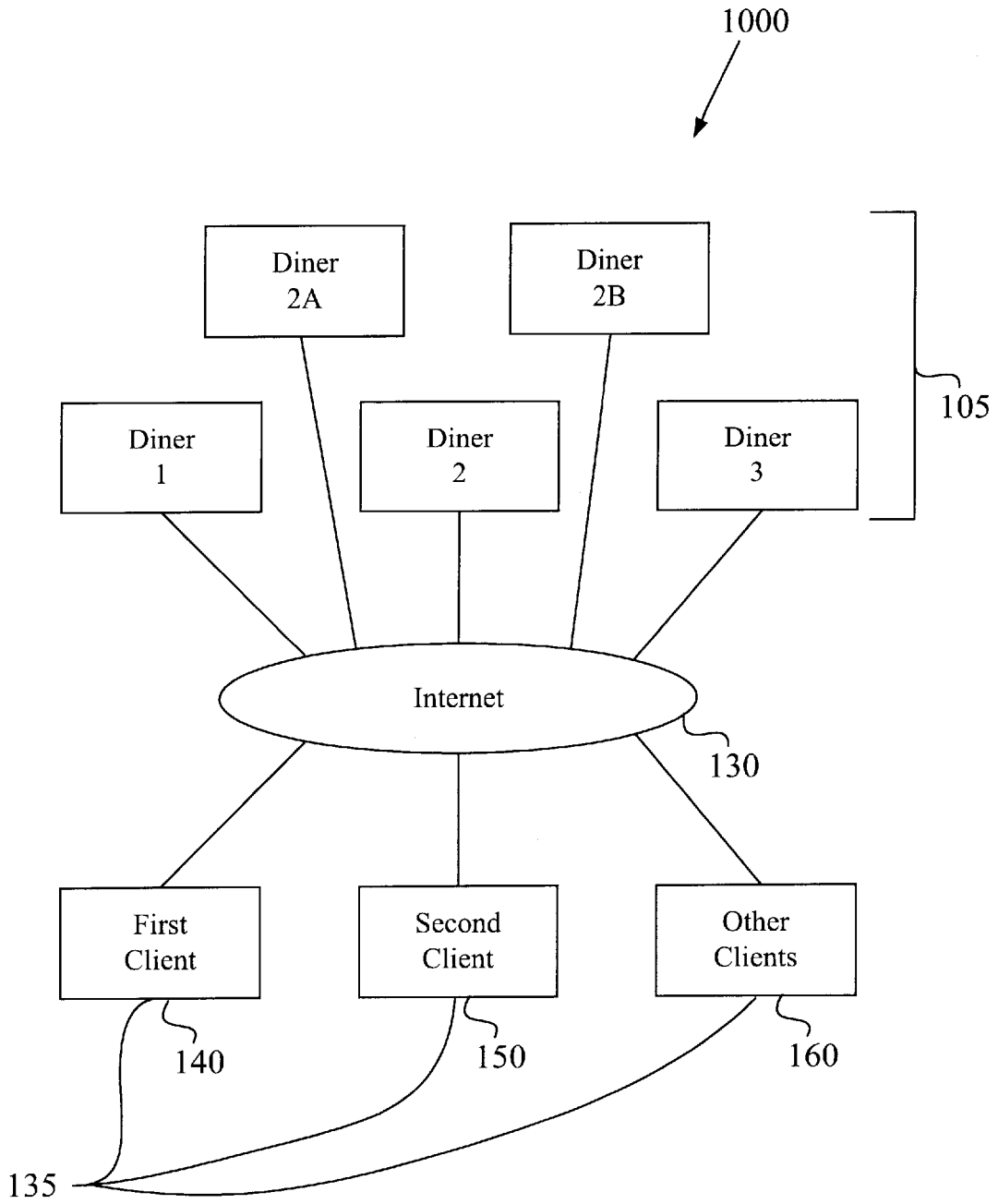
FIG. 10 is a block diagram illustrating an exemplary internet configuration for play of the game Diner.

Referring now to FIG. 10, a network 1000 is shown consisting of the internet 130 connected to exemplary servers 105 and clients 135. Franchising can be best understood by examining the network 1000. An example of a game which embodies the present invention is a restaurant simulator, hypothetically titled "Diner." As a simulator, Diner can be played from a number of perspectives. One such perspective, is that of the restaurant management. Objectives of a management perspective of the Diner game might be to operate a restaurant in an efficient and creative manner, to turn a profit, to achieve acclaim in the restaurant business, to win the accolades of local government for environmental sensitivity, and to enjoy employee appreciation for providing rewarding and stimulating jobs. The server game data 290 and knowledge base 280 stored in each respective server 105 defines each restaurant environment.

Each client 135 (player) that plays the game acts a part time restaurant manager, and scores points during the period of game play for improving the restaurant (as measured against the game objectives). Server 105 stores the changes in game state data 330 made by the part time restaurant manager (client 135/player), which become part of the restaurant environment. Some players will make the environment better. Other players will not manage as well and may make the restaurant less efficient. As in real life, the restaurant may be managed into renown and prosperity or may be managed into destitution and oblivion.

The server 105 manager (the person who maintains the game server) maintains control over the restaurant by controlling who plays the game (and thus who manages the restaurant) and by limiting what changes each player can effect based on experience or other criteria. A starting player for instance may be assigned the rank of "night manager trainee" while the most experienced players may be titled "head chef." A player may be promoted or demoted based on management success relative to the game objectives.

The network 1000 includes Diner 1, Diner 2 and Diner 3. Each diner is preferably operated on a different server 105 by a different server 105 manager, who wants to appeal to a different clientele. Thus, each server 105 manager may limit the changes available to the players. For example, the first server 105 manager may want Diner 1 to appeal to a professional lunch clientele, the second server 105 manager may want Diner 2 to appeal to family diners, and the third server manager may want Diner 3 to appeal to younger diners. Accordingly, each player will use different advertising approaches, will serve different foods, will have different waiter/waitress uniforms, etc. Accordingly, each diner will presumably attract a different number of patrons and will produce differing profits. If the player of family Diner 2 wants to add a pinball machine, then the server 105 manager probably will allow this addition even by a low experience player. However, if the player wanted to offer gourmet wines to the family guests, then the server 105 manager would probably not allow this business decision unless the part time manager had a significant amount of accrued experience. A continuous parameter of the game effecting many of the business decisions which are made during game play (adding a pinball machines or investing in expensive wines), is that the diner has a finite amount of cash and credit available and must, at least over an extended period, produce a profit. For instance, one effect of this profit parameter might be that since the player is role-playing as an employee of the diner, as the player's skills improve and result in promotion to higher levels of management, employee costs resulting from these promotions will also increase. The increasing employee costs will necessarily require the player to thus do a better job of managing with each promotion, in order to avoid reducing profitability of the diner.

If a multitude of clients 135 frequented Diner 2 causing server 105 to overload, the server 105 manager may choose to franchise the Diner 2 game. Server 105 manager can advertise the availability of game franchises on internet 130. Data relating to the advertisement and availability of franchises is preferably stored as a component of the global directory 370. Accordingly, the server manager arranges a franchising with another server 105 connected to the internet 130 and loads a copy of the server game executable 270 and a copy of the Diner 2 server game data 290 onto the new server 105. The new diner game is illustrated in FIG. 10 as "Diner 2A." Although initially Diner 2 and Diner 2A will have the same game state, each diner will develop unique characteristics as the game progresses.

The server 105 manager may optionally maintain complete game independence between Diner 2 and Diner 2A. Accordingly, each player can listen in and effect changes to only one diner at a time. The client 135/player selects either Diner 2 or Diner 2A to manage and thus listens in on that server 105 game. Alternatively, the server 105 manager may enable communication between Diner 2 and Diner 2A to allow profit sharing, combined advertising, coupons redeemable at either diner or the like. Changes made to Diner 2 by the player could thus effect the efficiency or profitability of Diner 2A.

If a franchise server 105 manager recognizes the particular success of the Diner 2 game, the franchise server 1 OS manager may contact the Diner 2 server manager (franchiser) to acquire the Diner 2 game data. Accordingly, the franchise can operate another instance of the Diner 2 game, illustrated in FIG. 10 as "Diner 2B." Like Diner 2A, Diner 2B will initially be identical to Diner 2. However, since another server 105 manager will control the operations of the Diner 2B and since different clients 135 will listen in and effect different changes, Diner 2 and Diner 2B will develop different environments. Thus, clients 135 wanting to manage a family diner can manage one of Diner 2, Diner 2A or Diner 2B. An obvious but interesting aspect of this game play, is that game play is actually occurring not only by the player/clients 135, but also in the actions taken by the server 105 managers in enhancing and maintaining the Diner servers 105.

A second perspective of the game which may be played in the game Diner is that of the customer. In this perspective of the Diner game, the client 135 plays the role of a Diner customer. Objectives of the customer may include a pleasant dining environment, well-prepared healthy food, efficient service, and reasonable pricing. In the preferred embodiment, the player has the option of defining and specifying a relative importance to each of the game objectives. For instance, the player may define a pleasant dining environment as being a quiet seating area with low lights and soft music. Efficient service may be defined as being seated within ten minutes, with food service within 30 minutes. The player may further specify that efficient service is more important than a pleasant dining environment. Parameters such as health and happiness are measured relative to the player's objectives. Illustrating the concept of client continuity discussed with reference to FIG. 5 above, the player can "enjoy" virtual dining experiences at various diners run by different servers 105, while accumulating health and happiness along the way. To the extent that the diner (server 135 manager) can satisfy the objectives of the player, the diner will become more popular and prosperous.

The foregoing description of the preferred embodiments of the invention is by way of example only, and other variations of the above-described embodiments and methods are provided by the present invention. For example, although the system 100 has been described with reference to a game, the invention supports any continuous and progressive virtual environment. Additionally, with respect to game play, variations include the continuous game play of substantially different games. For instance, as an extension of the Diner game embodiment previously described, a health club game for high performance restaurant managers could also be designed using capital raised from the Diner operation. The healthier customers of the Diner game could engage in continuous game-play with a mountain climbing or running club game. Resource from the Diner restaurant related to health and happiness could also be applied to this mountain or running club game by the client/player.

Furthermore, it is not necessary that these alternative game embodiments necessarily operate on separate franchise servers. A single franchise could potentially operate the multiple games. Components of this invention may be implemented using a programmed general purpose digital computer, using application specific integrated circuits, or using a network of interconnected conventional components and circuits. It should be noted that the present invention can be stored on a computer readable medium such as a diskette, CD-ROM, magnetic tape, or fixed or removable hard drive. Additionally, the present invention can be down-loaded through a computer network onto a host computer or other suitable electronic system. The embodiments described herein have been presented for purposes of illustration and are not intended to be exhaustive or limiting. Many variations and modifications are possible in light of the foregoing teaching. The system is limited only by the following claims.

What is claimed is:

1. A system enabling game-playing across a computer network, the system comprising:

a franchiser memory storing a franchiser game executable and original initialization game data;

a first game server enabled to communicate with the franchiser memory and connected to the computer network, the first game server having a first server memory storing a first server game executable derived from the franchiser game executable and first server game state information which includes first server initialization data derived from the original initialization game data and first server client data; and a first game-playing client connected to the computer network having a first client memory storing a first client game executable which enables the client to continuously game-play on the first game server and a first client game state used by the first client game executable in maintaining continuous game-play.

2. The system according to claim 1, further comprising a second game server connected to the computer network having a second server memory storing:

a second game server executable; and second server game state information which includes second server initialization data and second server client data, the second server game state information being different from the first server game state information.

3. The system according to claim 2, wherein the first client game executable enables the first game-playing client to continuously game-play on the second game server as well as the fist game server.

4. The system according to claim 2, wherein the first server game executable and the second server game executable are substantially the same.

5. The system according to claim 2, wherein the first server initialization data and the second server initialization data are different.

6. The system according to claim 5, wherein the differences between the second server game state information and the first server game state information presents the game-playing client with different game situations.

7. The system according to claim 2, wherein the first server client data and the second server client data are different.

8. The system according to claim 2, wherein the first server memory receives and stores external input data.

9. The system according to claim 6, wherein the second server memory receives and stores external input data, and said stored external input data stored by the second server memory is different than said external input data stored in the first server memory.

10. The system according to claim 2, wherein the second game server is a franchise of the first game server.

11. The system according to claim 2, wherein the first game server and the second game server communicate to exchange game information.

12. The system according to claim 2, wherein the first game-playing client plays continuously by storing the first client game state from a first game session and uses the stored game state in a subsequent game session.

13. The system according to claim 12, wherein the first game session is played by the first game-playing client on the first game server and the subsequent game session is played on the second game server.

14. The system according to claim 2, further comprising a second game-playing client connected to the computer network having a second client memory storing a second client game executable which enables the client to continuously game-play on at least one of the first and second game servers, and a second client game state used by the second client game executable in maintaining continuous game-play.

15. The system according to claim 14, wherein the first game server maintains continuous game play between both the first game playing client and the second game-playing client.

16. The system according to claim 15, wherein the continuous game-play maintained by the first game server is maintained by storing on-going game information in the first server memory.

17. The system according to claim 2, further comprising a second game-playing client connected to the computer network having a second client memory storing a second client game executable which enables the client to continuously game-play on at least one of the first and second game servers, and a second client game state used by the second client game executable in maintaining continuous game play, wherein the first server concurrently maintains game-play with the first and second game-playing clients by storing game state information related to each client in first server memory.

18. The system according to claim 2, wherein the first server game executable and the second server game executable are variations of the same type of game.

19. The system according to claim 2, wherein the first server game executable and the second server game executable are substantially different games which are related by the game-play of the first game-playing client.

20. The system according to claim 1, wherein the first game server controls the privilege and access of the first game-playing client to the first server memory.

21. The system according to claim 1, wherein continuous game-play is further maintained by the first game server, by storing on-going game information in the first server memory.

22. A system enabling game-playing across a computer network, the system comprising:

a franchiser memory storing a franchiser game executable and original initialization game data;

a first game server enabled to communicate with the franchiser memory and connected to the computer network, the first game server having a first server memory storing a first server game executable derived from the franchiser game executable and first server game state information which includes first server initialization data derived from the original initialization game data and first server client data;

a second game server connected to the computer network having a second server memory storing a second game server executable and second server game state information which includes second server initialization data and second server client; and a first game-playing client connected to the computer network having a first client memory storing a first client game executable which enables the client to concurrently game-play on the first and second game servers and a first client game state used by the first client game executable in maintaining concurrent game-play.

23. A system for game play across a network, the system comprising:

a first game-playing client connected to the network;

a first server connected through the network to the first game-playing client, including game data memory for storing dynamic game data;

knowledge base memory for storing knowledge base rules; and an executable computer game program for applying the knowledge base rules to the game data to generate game responses to the first game-playing client; and a second server connected to the network, including dynamic game data derived from the dynamic game data of the first server.

24. The system of claim 23, wherein the dynamic game data comprises:

initial data specifying an initial game state; and accumulated data specifying modifications to the initial data.

25. The system of claim 23, wherein the knowledge base rules comprise virtual environment rules.

26. The system of claim 23, further comprising a second game-playing client connected through the network to the first server.

27. The system of claim 23, wherein the first server further comprises an inference engine which derives new rules from the knowledge base rules and the game data dynamic information and stores these new rules in the knowledge base memory.

28. The system of claim 23, wherein the first server receives external data relating to the game and stores the external data in the game data memory.

29. The system of claim 23, wherein the second server includes an executable game program substantially identical to the executable game program of the first server.

30. The system of claim 23, wherein the second server further includes knowledge base rules derived from the knowledge base rules of the first server.

31. The system of claim 30, wherein the game data and knowledge base rules of the second server are identical to the corresponding game data and knowledge base rules of the first server.

32. A system for game play across a network, comprising:

a first server connected to the network and including game data memory storing dynamic game data;

a first game-playing client connected through the network to the first server and including knowledge base memory storing knowledge base rules; and an executable computer game program for applying the rules to the game data to generate game responses to the first game-playing client; and a second server connected to the network, including dynamic game data derived from the dynamic game data of the first server.

33. The system of claim 32, wherein the dynamic game data comprises:

initial data specifying an initial game state; and accumulated data specifying modifications to the initial data.

34. The system of claim 32, wherein the knowledge base rules comprise virtual environment rules.

35. The system of claim 32, further comprising a second game-playing client connected through the network to the first server.

36. The system of claim 32, wherein the second server includes an executable game program substantially identical to the executable game program of the first server.

37. The method of claim 36, wherein the game data includes initial game data and accumulated game data.

38. The system of claim 32, wherein the second server includes knowledge base rules derived from the knowledge base rules of the first server.

39. The system of claim 32, wherein the game data of the second server is identical to the game data of the first server.

40. The system of claim 32, wherein the game-playing client further comprises an inference engine which derives new rules from the knowledge base rules and the game data dynamic information and stores these new rules in the knowledge base memory.

41. The system of claim 32, wherein the first server receives external data relating to the game and stores the external data in the game data memory.

42. A system for supporting a virtual environment, comprising:

a first server including a first memory storing server data including initial data specifying an initial game state and accumulated data specifying initial game state modifications, a knowledge base including virtual environment rules, and a server executable for applying the virtual environment rules to the game data;

a communications interface coupled to the memory enabling a plurality of clients to communicate with the server executable; and a second server coupled to the first server, including a second memory storing dynamic game data derived from the dynamic game data of the first server.

43. The system of claim 42 wherein the memory further stores an inference engine for deriving new virtual environment rules to include in the knowledge base.

44. The system of claim 42 further comprising a client coupled through an internet to the server.

45. The system of claim 44 further comprising a second client coupled through the internet to the first server.

46. The system of claim 42 wherein the accumulated data includes information on real world events and on artificially-generated events.

47. The system of claim 42 wherein the second memory stores a second knowledge base which is derived from the knowledge base of the first server.

48. A method for franchising a server game environment from a first server to a second server, comprising the steps of:

executing game play instructions on a first server by a client;

storing game data by the client to game data memory in the first server;

storing knowledge base rules by the client to a knowledge base memory in the first server;

transferring the contents of the data memory and the knowledge base memory from the first server to a second server; and executing game play instructions on the second server by the client using the transferred data memory and the knowledge base memory contents.

49. A method for franchising a server game environment from a first server to a second server in a computer network, comprising the steps of:

retrieving game data from a first game data memory in the first server;

retrieving knowledge base rules from a first knowledge base memory in the first server;

storing the retrieved game data in a second game data memory and the retrieved knowledge base rules in a second knowledge base memory in the second server; and attaching the second server to the computer network.

* * * * *